United States Patent [19]

Uchida

[11] 3,951,350

[45] Apr. 20, 1976

[54] METHOD AND APPARATUS FOR SUPPLYING A COP TO EACH WINDING UNIT OF AN AUTOMATIC WINDER

[75] Inventor: Hiroshi Uchida, Kyoto, Japan

[73] Assignee: Murata Kikai Kabushiki Kaisha, Kyoto, Japan

[22] Filed: Apr. 29, 1974

[21] Appl. No.: 465,375

[30] Foreign Application Priority Data

May 4, 1973 Japan ..... 48-50099

[52] U.S. Cl. ..... 242/35.5 A

[51] Int. Cl.[2] ..... B65H 54/20; B65H 67/06

[58] Field of Search ..... 242/35.5 A, 35.5 R, 242/35.6 R

[56] References Cited

UNITED STATES PATENTS

| | | | |
|---|---|---|---|
| 3,111,280 | 11/1963 | Reiners et al. | 242/35.5 R |
| 3,261,562 | 7/1966 | Kupper | 242/35.6 R |
| 3,265,316 | 8/1966 | Furst | 242/35.6 R |
| 3,373,946 | 3/1968 | Prasil | 242/35.6 R |
| 3,399,840 | 9/1968 | Hayashi et al. | 242/35.5 R |

*Primary Examiner*—Stanley N. Gilreath

*Attorney, Agent, or Firm*—Burgess Ryan and Wayne

[57] ABSTRACT

Each winding unit of the apparatus is provided with a fresh cop reserving magazine and a chute for transferring a fresh cop from the magazine to a peg for supporting the cop. A bucket conveyer for carrying a plurality of fresh cops is disposed at a position behind and adjacent a row of winding units and each winding unit is provided with a chute for transferring a fresh cop from the conveyer to the peg. A device for selecting the supply source of the fresh cop from either one of the above-mentioned magazine and bucket conveyer and a mechanism for controlling the cop supply operation are mounted to each winding unit.

9 Claims, 12 Drawing Figures

METHOD AND APPARATUS FOR SUPPLYING A COP TO EACH WINDING UNIT OF AN AUTOMATIC WINDER

SUMMARY OF THE INVENTION

The present invention relates to a method and apparatus for supplying cops to each winding unit of an automatic winder where a plurality of winding units are installed and which are stationary.

In conventional winding machines provided with a plurality of stationary winding units where a cop reserve magazine is mounted to each winding unit, a plurality of full packaged cops, for example, 6 full packaged cops, are reserved in the magazine of each winding unit. One of the drawbacks of conventional winding machines is that, if the number of winding units which are operated by an operator is increased beyond that which the operator is capable of operating efficiently, the reserve cops in the magazines are often exhausted so that the winding operation is stopped because of the occurrence of unexpected trouble which will require the attention of the operator.

The main purpose of the present invention is to provide an improved method and apparatus which solves the above-mentioned drawback of the conventional winder.

To attain the purpose of the present invention, a cop carrying conveyer is disposed at a position adjacent to a row of winding units in such a way that the conveyer carries a plurality of full packaged cops along a passage which is formed in parallel to a lengthwise direction of the winding machine. Each winding unit is, provided with a cop reserve magazine which, is capable of receiving a full packaged cop from the cop carrying conveyer or from the cop reserve magazine, alternatively.

According to our experience in mill operations, cops which fail the yarn retrieving motion should be discharged outside the magazine because, if the above-mentioned defective cops occupy the magazine, the working efficiency of the winding unit will be lowered. However, as such defective cops should, if possible, be used for forming yarn packages so as to avoid wasting the yarn thereon, such defective cops are again supplied into the cop reserve magazine as a group or in mixed condition with normal full packaged cops. Based on our repeated mill tests, it was concluded that, to maintain the working efficiency of the winding operation, fresh cops should be supplied to the winding unit with priority to the cops in the cop reserve magazine over the cops carried by the cop carrying conveyer.

Other objects and characteristic features of the present invention will be more clearly understood from the detailed illustration of the present invention, with reference to the attached drawings. Many modifications within the spirit of the present invention as set forth in the claims appended hereto may be made and the invention is not to be limited except by the spirit and scope of the invention as defined in the claims appended hereto.

DETAILED ILLUSTRATION OF THE PRESENT INVENTION

Figure 1:
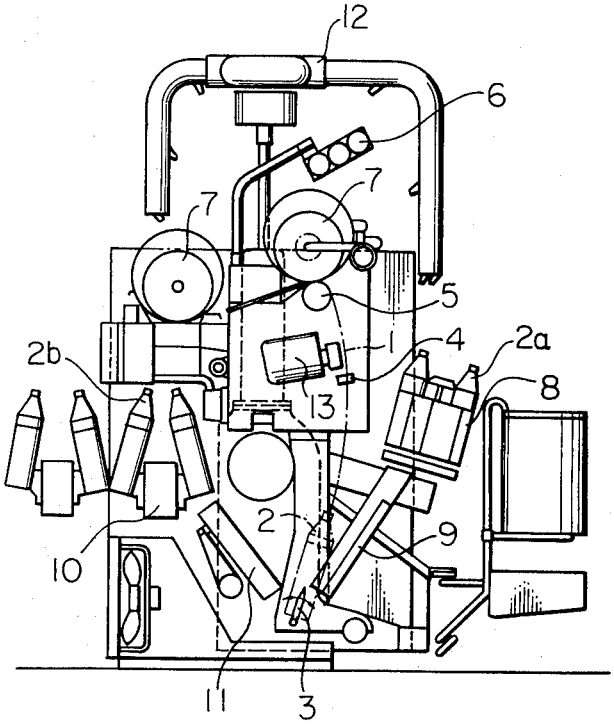
FIG. 1 is a schematic side view of the winding machine provided with a cop supply apparatus according to the present invention.
Figure 2:
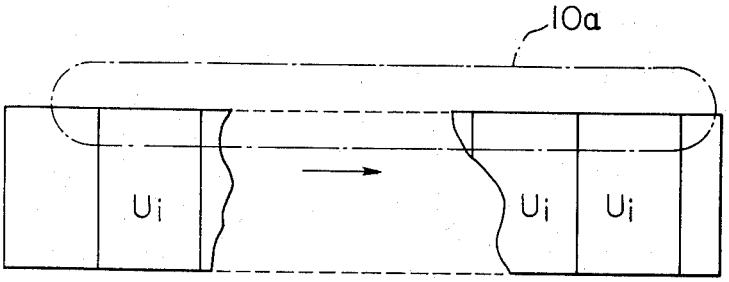
FIG. 2 is a brief plan view of the winding machine shown in FIG. 1.
Figure 3:
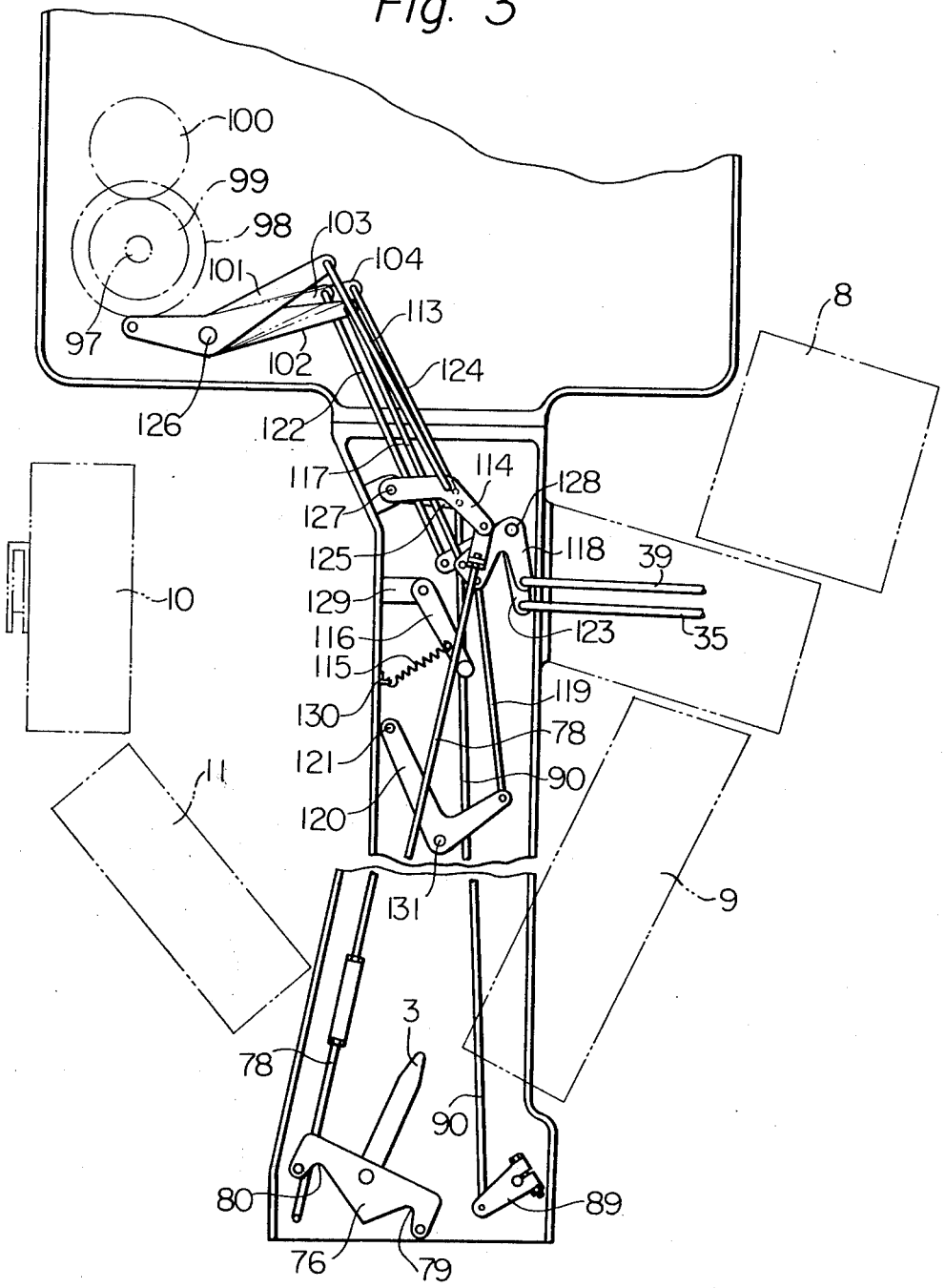
FIG. 3 is a schematic side view of a main portion of the cop supply apparatus of a winding unit shown in FIG. 1.

Referring to FIGS. 1, 2 and 3, in each winding unit Ui of the winding machine provided with the cop supply apparatus according to the present invention, a yarn 1 unwinds from a cop 2 which is held by a cop supporting peg 3. The cop supporting peg 3 is disposed at a bottom portion of the winding unit Ui, is wound on a bobbin 6 by a winding mechanism 5 so as to form a yarn package 7 after passing through the yarn guide 4 provided with a slub catcher (not shown). When the cop 2 held by the cop supporting peg 3 is exhausted, a fresh cop **2*a* reserved in a cop reserve magazine 8 is supplied to the peg 3 via a chute 9 after removing the bobbin of the exhausted cop 2 from the peg 3. If the cop reserve magazine 8 is empty, a fresh cop 2b carried by a bucket conveyer 10 is supplied to the peg 3 via a chute 11 after removing the bobbin of the exhausted cop 2 from the peg 3. In this embodiment, the bucket conveyer 10 is a conventional endless type bucket conveyer disposed at a position adjacent to a row of winding units Ui in such a way that the conveyer 10 carries a plurality of full packaged cops along a passage 10*a* which is formed parallel to the lengthwise direction of the winding machine, as shown in FIG. 2. An automatic knotting device 13 is mounted on each winding unit Ui and a travelling cleaner 12** is utilized for cleaning the machine.

Figure 4:
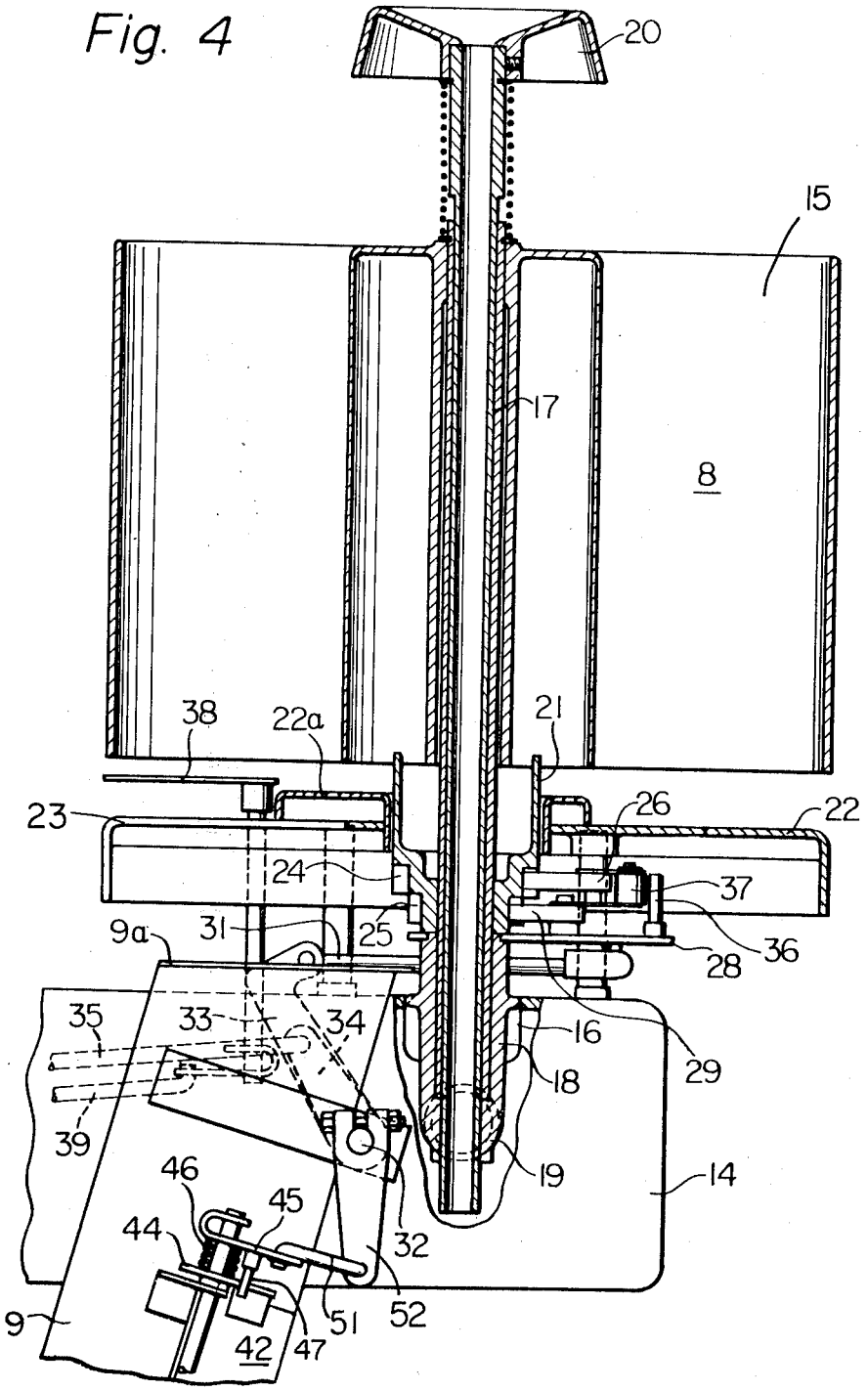
FIG. 4 is a schematic side view of a main portion of a cop reserve magazine and a related mechanism thereof shown in FIG. 1, taken along lines IV—IV of FIG. 5.
Figure 4A:
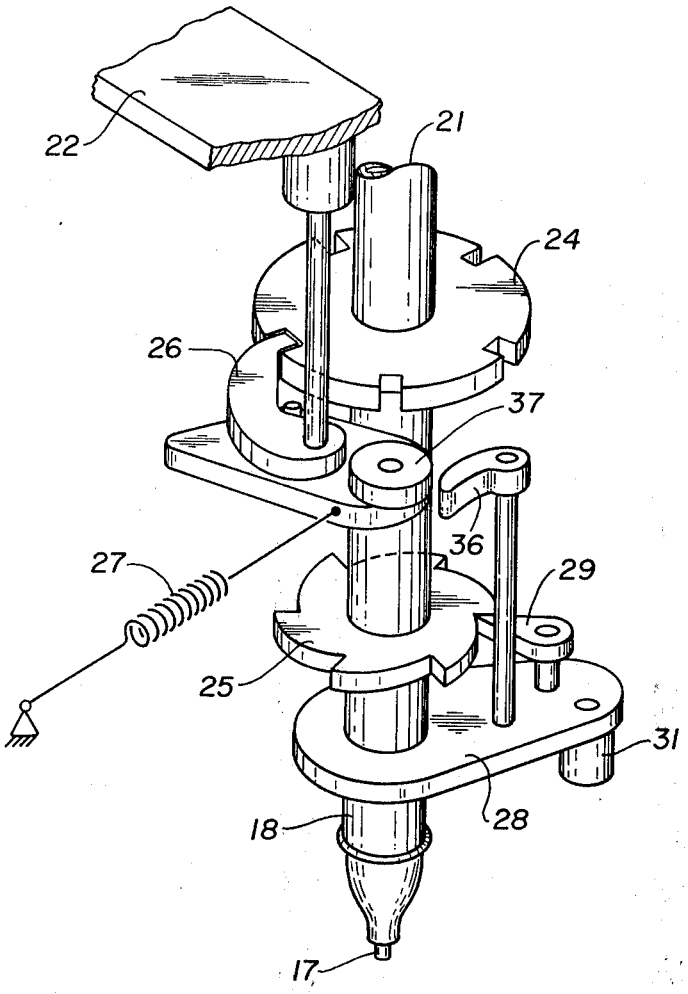
FIG. 4A is an expanded perspective view of the ratchet mechanism of FIG. 4.
Figure 5:
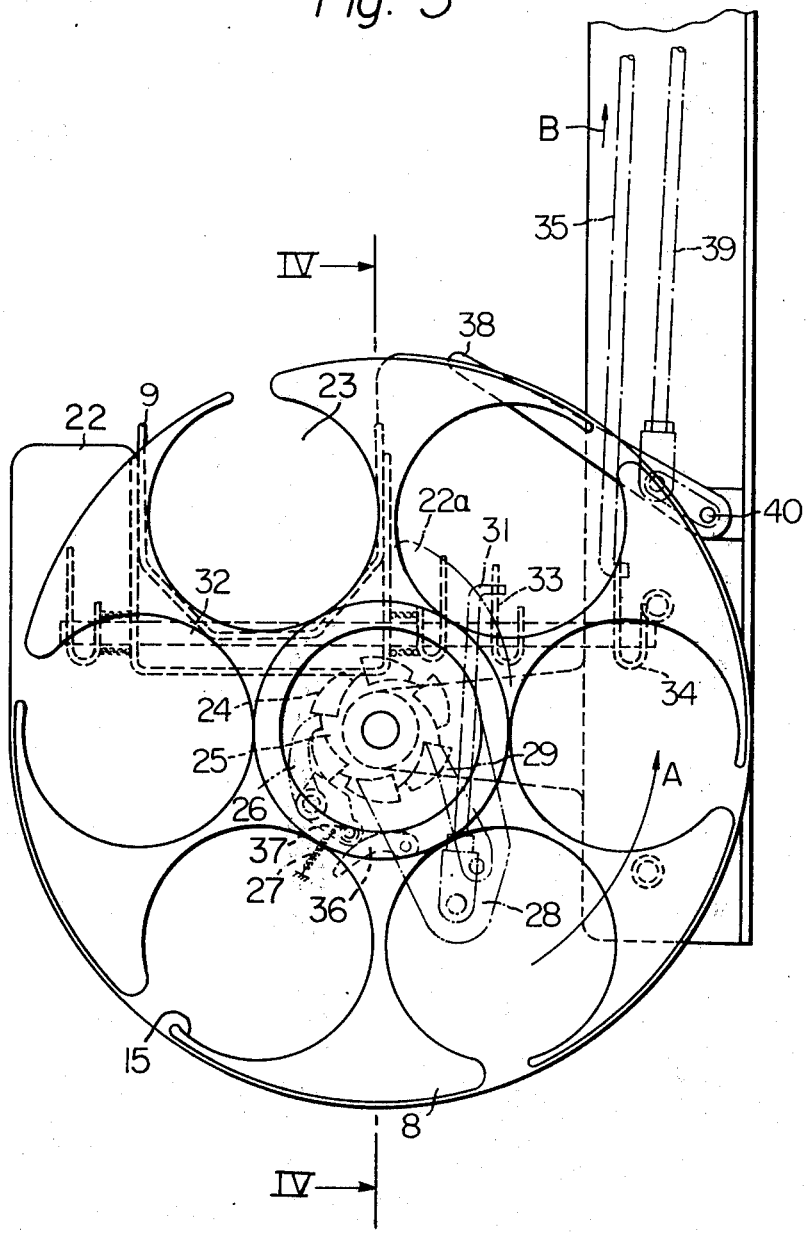
FIG. 5 is a schematic plan view of the cop reserve magazine and the related mechanism thereof shown in FIG. 4.

Referring to FIGS. 4 and 5, the cop reserve magazine 8 is provided with 6 compartments 15, each for reserving a fresh cop therein. The magazine is rotatably supported by an arm 16 which is secured to a bracket 14. That is, a hollow shaft 17 is rigidly held by a supporting member 18 vertically secured to the arm 16 which is rigidly mounted on the bracket 14. A bottom end of the hollow shaft 17 is connected to a suction conduit 19 disposed in the bracket 14, and the shaft 17 is provided with a funnel shaped aperture 20 at the top end portion thereof. To reduce the amount of suction air used, an on-off valve (not shown) is mounted on the suction conduit 19. The magazine 8 is rigidly mounted on a hollow holding shaft 21 which is rotatably mounted on the hollow shaft 17 as shown in FIG. 4. A cop supporting disc 22 is rigidly supported by the bracket 14 at a position below and coaxial with the magazine 8. To permit the turning motion of the magazine 8, the disc 22 is provided with an aperture formed at a central position thereof so that the hollow holding shaft 21 passes therethrough. The disc 22 is also provided with a cut-out portion 23 which permits escape of a fresh cop 2a downward therethrough, and the chute 9 is disposed adjacent and below the cut-out portion 23. The chute 9 is provided with a top aperture **9*a* which opens toward the above-mentioned cut-out portion 23. Therefore, when a fresh cop 2a reserved in any one of the compartments 15 of the magazine 8 is carried to the cut-out portion 23 of the disc 22 by turning motion of the magazine 8, the fresh cop 2*a* drops into the chute 9. In this embodiment, the magazine 8 is turned counterclockwise as shown by an arrow A in FIG. 5. A pair of ratchet wheels 24, 25 as illustrated in FIGS. 4 and 4A, are secured to the hollow holding shaft 21 at a position below the disc 22. A pawl 26 rotatably mounted on the bottom side of the disc 22 engages with the ratchet wheel 24 under pressure created by a spring 27. On the other hand, a pawl 29 turnably mounted on a lever 28 engages with the ratchet wheel 25 under pressure created by a suitable conventional spring not shown. A horizontal shaft 32 is secured to the chute 9 and a pair of levers 33 and 34 are rigidly mounted on the horizontal shaft 32. A control rod 35 is pivotably connected at its end to the lever 34 and a rod 31 is pivotably connected to a free end of the lever 33. The lever 28 is turnably mounted with respect to the holding shaft 21 and a free end thereof is pivotably connected to the other end of the rod 31. Consequently, when the control rod 35 is pulled toward a direction represented by an arrow B is FIG. 5, the shaft 32 is rotated, causing the lever 28 to rotate due to its connection with lever 31. As a result a guide 36 secured to the lever 28 pushes a roller 37 on the pawl 26 so that the pawl 26 is disengaged from the ratchet wheel 24 and, as a result, the pawl 29 actuates to turn the ratchet wheel 25 by one tooth thereof. In other words, the magazine 8 is turned an angle which corresponds to one compartment 15. Next, the rod 35 is displaced in a direction opposite to the direction B, so as to turn the lever 28 clockwise in FIG. 5, and as the guide 36 is disengaged from the roller 37, the pawl 26 engages the ratchet wheel 24 so that possible reverse turning of the magazine 8 can be prevented. Suitable conventionally mounted springs are provided for urging the pawl 26 against the ratchet 24 and for urging the pawl 29 against the ratchet 25. A lever 38 for detecting the existence of a fresh bobbin 2a in the compartments 15 of the magazine 8 is rotatably mounted on the bracket 14 by a pivot pin 40 adjacent to and upstream of the cut-out portion 23 of the disc 22 along the turning passage of the compartments 15. The detecting lever 38 is pivotably connected to an end of a rod 39. Therefore, the existence of a fresh cop 2*a* in the compartment 15 can be detected by the lever 38 by turning the lever 38 about the pivot pin 40 toward a guide plate 22*a* formed on the disc 22**.

Figure 6:
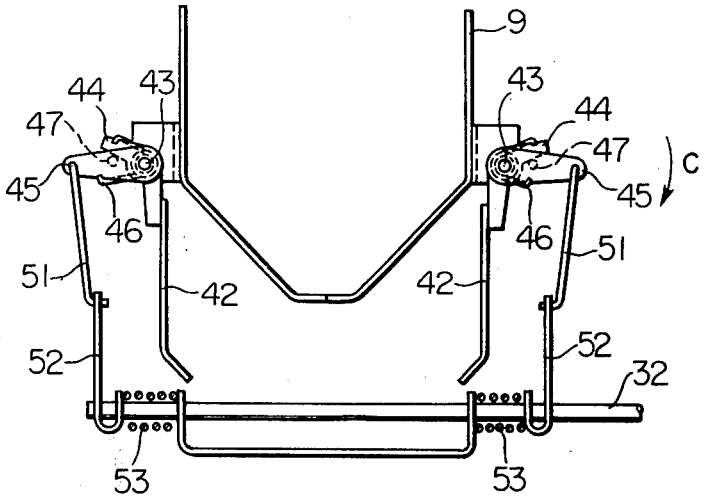
FIG. 6 is a schematic plan view of a cop chute whereby a cop is supplied from the cop reserve magazine to a cop supporting peg of each winding unit shown in FIG. 1.
Figure 7:
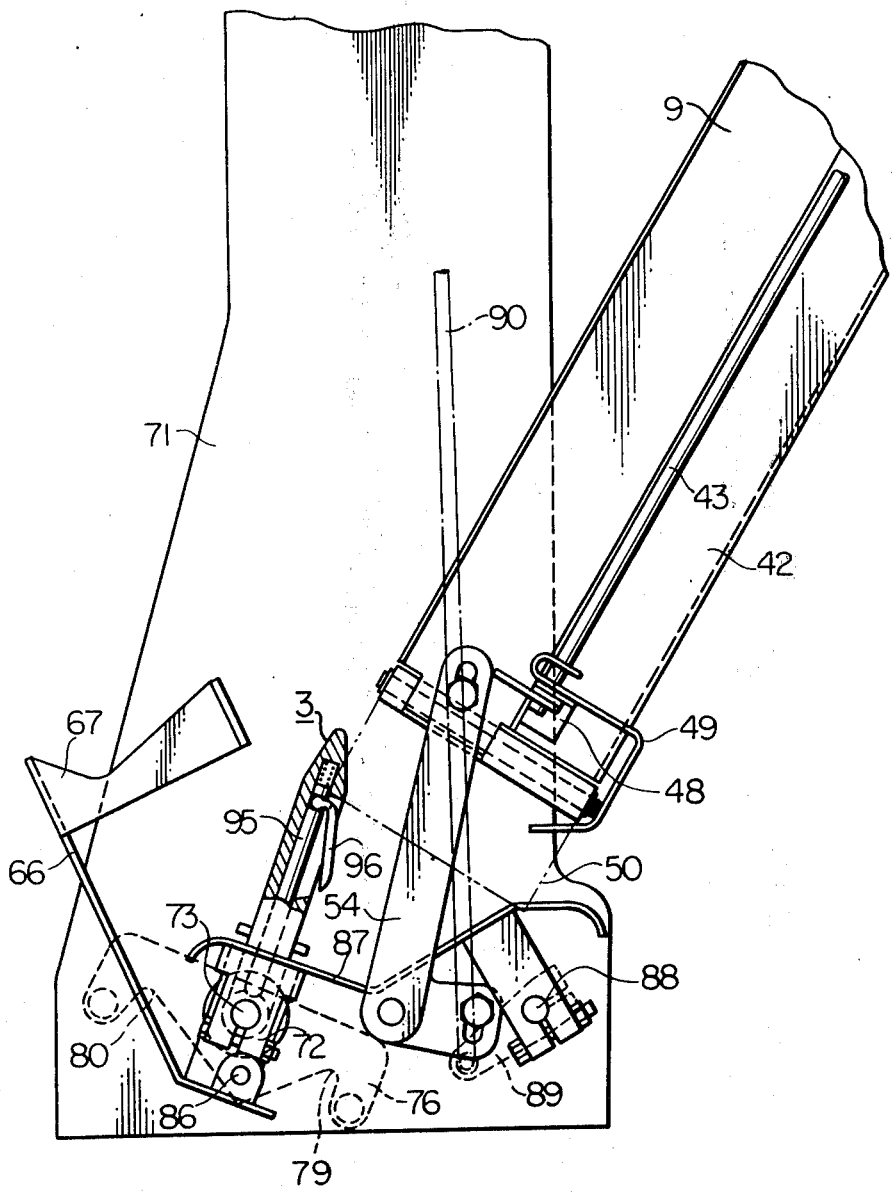
FIG. 7 is a schematic side view of the cop chute shown in FIG. 6 and its related mechanism.
Figure 9:
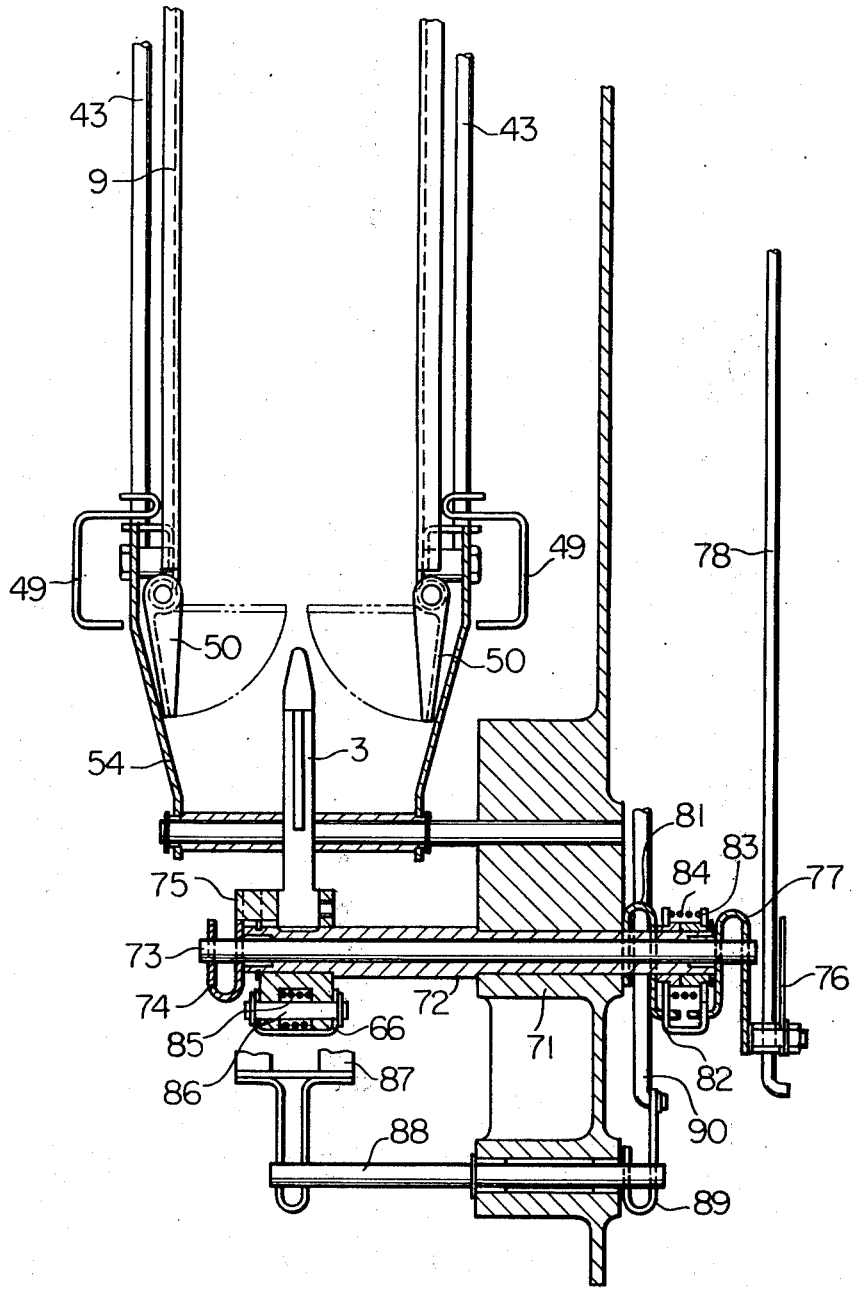
FIG. 9 is a schematic front view, partly in section, of the cop chute and a related mechanism shown in FIG. 7.

Referring to FIGS. 6, 7 and 9 the magazine side chute 9 comprises the above-mentioned top end portion having an aperture facing the cut-out portion 23 of the disc 22 and a lower main portion provided with a pair of doors 42 which open away from or close toward each other. Each door 42 is secured to a separate lever 44 pivotably mounted on the main body by separated shafts 43. Another lever 45 is rotatably mounted on each shaft 43 and a spring 46 is mounted on each shaft 43 in such a way that the two ends of the spring 46 are engaged with the lever 44 and the lever 45, respectively so that the pivotal turning of lever 44 around the shaft 43 is restricted by the pin 47 mounted on lever 45. Consequently, the movement of the doors 42 can be attained by turning the levers 45.

Each shaft 43 extends downward along the lengthwise direction of the chute 9 and the bottom end of each shaft 43 is held by a bracket 48. A lever 49 is secured to the shaft 43. At the bottom end of the chute 9, there is provided a pair of doors 50 (see FIG. 9) which open or close the bottom aperture of the chute 9. The lever 45 is connected to a lever 52 secured to the shaft 32, via a rod 51, and a pair of springs 53 mounted on the shaft 32 create a force for turning each lever 52 about the shaft 32 so as to always work to open the doors 42. When the rod 35 shown in FIG. 5 is pulled so as to turn the shaft 32, the lever 45 is rotated in a direction indicated by an arrow C in FIG. 6 and, as the lever 44 is turned with the lever 45, the doors 42 are closed. Thereafter, the lever 45 is further turned against the spring 46, so that the free edge of the levers 49 engage the doors 50 so as to close the doors 50. When the lever 45 returns to its rest position, the movements of the elements are exactly opposite to those mentioned above that is, the doors 50 are firstly opened and, thereafter, the doors 42 are opened. In the above-mentioned embodiment, the chute 9 is rigidly mounted on each winding unit Ui by a pair of levers 54 (only one of them is shown in FIG. 7).

Figure 8:
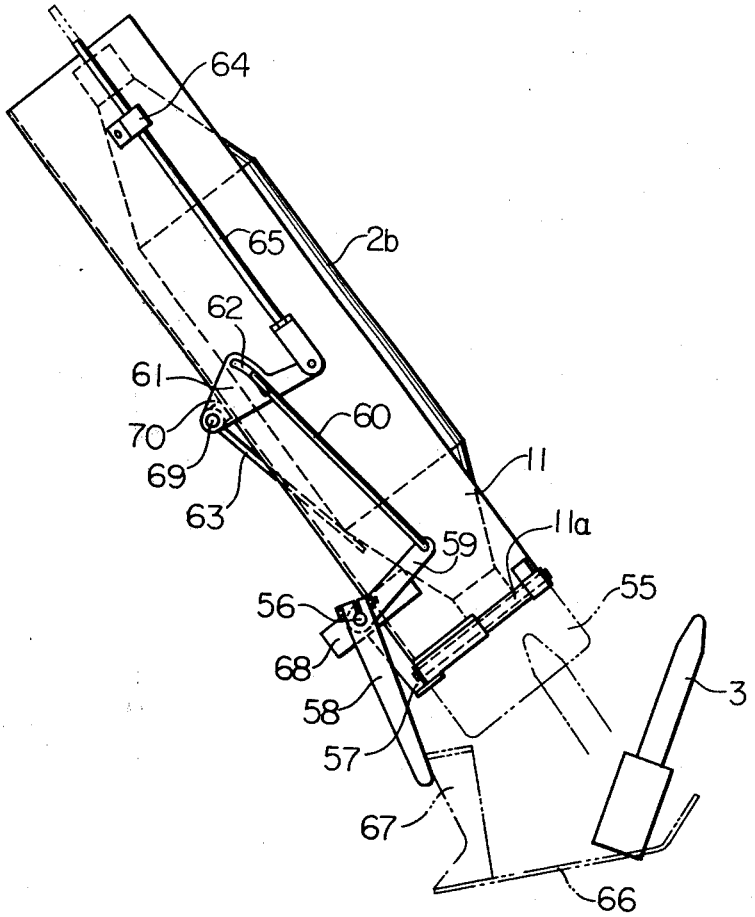
FIG. 8 is a schematic side view of a cop chute whereby a cop is supplied from a cop carrying conveyer to the cop supporting peg of each winding unit shown in FIG. 1.

Referring to FIG. 8, the conveyer side chute 11 is provided with a pair of doors 55 turnably mounted on shafts 11a disposed at the bottom sides of the chute 11 in facing condition. A hook member 57 is turnably mounted on a shaft 56 supported by a bracket 68 secured to a bottom portion of the chute 11 in such a way that the free end of the hook member 57 is forced to turn according to the turning motion of the shaft 56 by means of a spring (not shown) mounted on the shaft 56. The free end of hook member 57 is capable of engaging the doors 55 when they are closed in the waiting condition. A pair of levers 58 and 59 are secured to the shaft 56 so that the levers 58, 59 and the hook member 57 are capable of turning together. A shaft 69 is mounted on a bracket 70 secured to a middle side portion of the chute 11 and a fan shaped lever 61 is turnably mounted on the shaft 69. The lever 61 is provided with an arcuate slot 62. A free end of the lever 59 is pivotably connected to a bottom end portion of a connecting rod 60 and a top end of the connecting rod 60 is slidably engaged into the arcuate slot 62 of the lever 61. The lever 61 is always provided with a force urging it to turn counterclockwise about the shaft 69 by means of a spring (not shown) mounted on the shaft 69. A detecting lever 63 is secured at its top end to the shaft 69 and a free portion of the lever 63 is positioned in the chute 11. The lever 61 is pivotably connected to a bottom end of a rod 65 which is slidably held by a guide member 64 secured to a top side of the chute 11. When the chute 11 is empty, the detecting lever 63 enters into the chute 11 so that the rod 65 is positioned at its uppermost position as represented by a dotted line in FIG. 8. That is, in this condition, the top end portion of the rod 65 projects beyond the upper edge of the chute into a passage of a member for opening or closing a bucket door of the bucket conveyor 10. (The detailed construction of the buckets will be illustrated later). Therefore when the rod 65 engages the above-mentioned member for opening or closing the door of a bucket of the conveyor 10, the door is opened so that a fresh cop 2*b* carried by the bucket (not shown) of the bucket conveyor 10 drops into the chute 11. When the cop 2*b* drops into the chute 11, the detecting lever 63 is turned about the shaft 69 outwards from the chute 11 by the cop 2*b* and, consequently, the rod 65 is displaced to the holding position, which is represented by a solid line in FIG. 8, so that the rod 65 is held at a position away from the bucket conveyor 10. During the above-mentioned motion, the top end of the connecting rod 60 slides in the slot 62 and, therefore, the above-mentioned motion does not affect the lever 59 so that the doors 55 of the chute 11 are held in the closed condition.

When the peg 3 is turned toward a position where the peg 3 is capable of receiving a fresh cop 2*b* from the chute 11 as hereinafter illustrated in detail, an actuation member 66, which is constructed as one body with the peg 3, turns together with the peg 3. An arm member 67 secured to the actuation member 66 engages the lever 58 and the lever 58 is forced to rotate in the clockwise direction in FIG. 8. According to the above-mentioned rotating motion of the lever 58, the hook member 57 is separated from the doors 55 and, consequently, the fresh cop 2*b* reserved in the chute 11 drops toward the peg 3. In the above-mentioned cop supply motion, the connecting rod 60 pulls the lever 61 so that the rod 65 is further displaced downward so as to assure the condition that the rod 65 does not actuate a bucket of the bucket conveyer 10. When the peg 3 is turned to a winding position, the actuation member 66 is turned to its waiting position, the arm member 67 works to close the door 55 and the hook member 57 is forced to engage with the closed door 55 by means of a spring. In this condition, the detecting lever 63 turns counterclockwise in FIG. 8 so that the top end of the rod 65 is projected beyond the upper edge of the chute 11 into the passage of the bucket conveyer 10 so as to actuate a bucket of the conveyer 10.

Referring to FIGS. 3, 7 and 9, a hollow tube 72 is a rigidly mounted on the machine frame 71 and a shaft 73 is turnably mounted in the hollow tube 72. At one end portion of the shaft 73, the peg 3 is mounted by way of a lever 74 and a bracket 75, and a lever 77 is secured to the other end of the shaft 73, a plate 76 being secured to the lever 77. An end portion of the rod 78 is capable of engaging a recess 79 or a recess 80 of the plate 76 alternatively so as to turn the plate 76 counterclockwise or clockwise in FIG. 7 by pulling the rod 78 upward. A stop 81 is rigidly mounted on the machine frame 71, and L-shaped levers 82, 83 are disposed in an intervening space between the stopper 81 and the lever 77 in such a way that the levers 82, 83 are forced to approach each other by means of a spring 84. Therefore, when the rod 78 is displaced downward so that the rod 78 is disengaged from the plate 76, the lever 77 is turned so that the levers 82, 83 come into contact with the stopper 81 when the peg 3 is positioned at a normal winding position.

The actuation member 66 for opening or closing the doors 55 of the chute 11 is turnably mounted on a shaft 86 secured to the bracket 75 and the member 66 is forced to turn around the shaft 86 by a spring 85 mounted on the shaft 86. A bobbin discharging plate 87 is mounted on one end of a shaft 88 rotatably held by the machine frame 71. A lever 89 is secured to the other end of the shaft 88 and the lever 89 is connected to a connecting rod 90. When the connecting rod 90 is pulled upward in FIGS. 7 and 9, the bobbin discharging plate 87 is turned clockwise in FIG. 7 and an exhausted bobbin is taken off of the peg 3.

The peg 3 is provided with a sliding shaft 95 which is slidably inserted therein and a lever 96 which is capable of projecting a free end thereof outside the peg 3 according to the motion of the sliding shaft 95. The motion of the sliding shaft 95 is created by the rotating motion of the shaft 73. As the detailed construction of the peg 3 was disclosed in the Japanese Utility Model publication for disclosure Sho 48 (1973) No. 102347, the construction of the peg 3 is explained only briefly as mentioned above.

Figure 10:
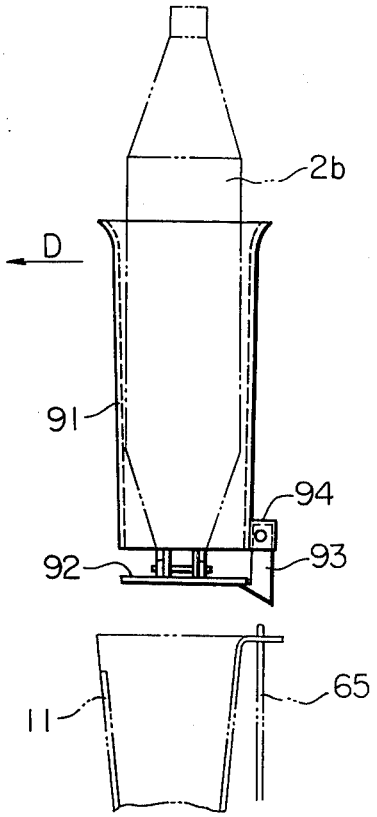
FIG. 10 is a schematic side view of a unit of a bucket conveyer utilized for the apparatus shown in FIG. 1.

Referring to FIG. 10, the bucket conveyer provided with a plurality of buckets 91 carries fresh cops 2*b* along the passage which passes over a row of the chutes 11. In this drawing the bucket 91 is displaced in a direction represented by an arrow D. Each bucket 91 is provided with a door 92 rotatably disposed at a bottom position of the bucket 91 and the door 92 is maintained in its closed position by engagement with a hook member 93 which is rotatably mounted on a bracket 94 secured to a bottom side portion of the bucket 91. As already illustrated in the previous explanation related to the chute 11, the rod 65 of the chute 11 is capable of occupying a position where the top end of the rod 65 engages with the hook member 93 so as to turn it according to the displacement of the bucket 91. Therefore, when the top end portion of the rod 65 turns the hook member 93, the fresh cop 2*b* carried by the bucket 91 drops therefrom and is received by the chute 11.

Figure 11:
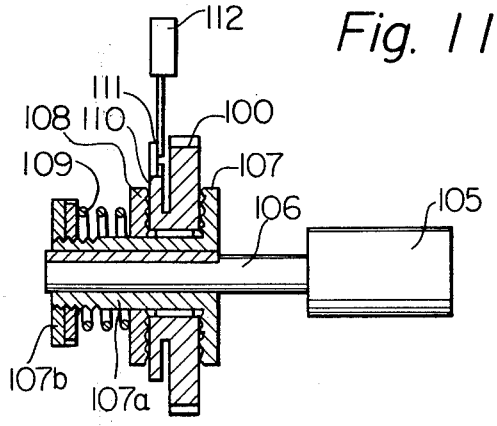
FIG. 11 is a schematic side view, partly in section of a cam control mechanism utilized for the apparatus shown in FIG. 1.

Referring to FIGS. 3, 4, 5 and 11, a group of control cams 98 are rigidly mounted on a shaft 97 which is in turn rotatably mounted on a machine frame. A gear 99 is also rigidly mounted on the shaft 97. A gear 100 of a one-revolution clutch shown in FIG. 11 meshes with the gear 99 having the same number of teeth as the gear 100 and, consequently, when the gear 100 turns one revolution, the group of cams 98 also turn one revolution, respectively. A plurality of levers 101, 102, 103 and 104 are rotatably mounted on a shaft 126 mounted on the machine frame, in such a condition that these levers 101, 102, 103 and 104 are in contact with the respective control cams of the cam group 98 so that free ends of these levers 101, 102, 103 and 104 are capable of swinging about the shaft 126 according to the rotating motion of these cams 98, respectively. As shown in FIG. 11, the one revolution clutch mechanism comprises a drive motor 105, a friction disc 107 secured to a shaft 106 of the motor 105, another friction disc 108 rotatably mounted on an extended hollow shaft portion 107*a* of the friction disc 107, a stopper 107*b* rigidly mounted on an end portion of the extended hollow shaft portion 107*a*, a helical spring 109 mounted on the hollow shaft portion 107*a* at a position between the friction disc 108 and the stopper 107*b* so as to push the friction disc 108 toward the friction disc 107. A gear 100 provided with a clutch plate 110 is rotatably mounted on the extended hollow shaft portion 107*a* at a position between the friction discs 107 and 108, and a solenoid 112 provided with a plunger which works as a pawl 111 is provided which is capable of engaging with a notch (not shown) formed in the clutch plate 110. To rotate the gear 100 by the friction torque created by the frictional contact of the gear 100 and the clutch plate 110 with the friction discs 107, 108 respectively, the contact surfaces of these friction discs 107, 108 are provided with surfaces having suitable frictional resistance. Consequently, when it is required to turn the gear 100 through one rotation, the solenoid 112 is actuated to retract the plunger so as to disengage the pawl 111, as seen in FIG. 11, from the notch (not shown) of the clutch plate 110 so that the clutch plate 110 can commence to turn according to the frictional driving force of the friction discs 107 and 108. After a fraction of a second, the solenoid 112 is de-energized so that the pawl 111 of the plunger is pushed toward the clutch plate 110. Consequently, when the notch (not shown) of the clutch plate 110 returns to its initial position, the pawl 111 is engaged into the notch of the clutch plate 110 so that the gear 100 is stopped after one revolution.

Referring to FIG. 3, a lever 114 is rotatably mounted on a bracket 127 secured to the machine frame. The lever 101 is connected to the lever 114 by way of a connecting rod 113, and the lever 114 is pivotably connected to a top end portion of the rod 78. In this condition, the lever 114 is always provided with turning force toward the left hand side in FIG. 3 which is created by a lever 116 and a spring 115. The lever 116 is pivotally mounted on a bracket secured to the machine frame and the spring 115 is connected at one end portion to a pin 130 secured to the machine frame and is connected at its other end to the lever 116. The lever 102 is connected to a lever 118, turnably mounted on a shaft 128 secured to the machine frame, by way of a connecting rod 117. The lever 118 is connected to the rod 39 of the detecting lever 38, and further connected to an L shaped lever 120, which is rotatably mounted on a shaft 131 secured to the machine frame, by way of a connecting rod 119. At an end of the L shaped lever 120, there is provided a pin 121. When the rod 39 is pulled toward the right hand side in FIG. 3, the above-mentioned pin 121 contacts the rod 78 and the rod 78 is forced to turn toward the right hand side in FIG. 3 according to the further pulling motion of the rod 39. Consequently, the bottom end of the rod 78 is forced to displace from the recess 80 to the recess 79. The lever 103 is connected to a lever 123, which is turnably mounted on the shaft 128, by way of a connecting rod 122. The lever 123 is connected to the rod 35 so as to be able to turn the cop reserve magazine as already illustrated in the explanation relating to the cop reserve magazine 8. A lever 104 is connected to the rod 90 by way of a connecting rod 124 and the lever 125 so as to be able to discharge an exhausted bobbin from the peg 3.

Next the operation of the above-mentioned apparatus is hereinafter illustrated in detail.

When it is necessary to supply a fresh cop 2*a* or 2*b* to the peg 3 of a winding unit, for example, a detector (not shown) disposed at a position adjacent to a yarn passage between the peg 3 and the yarn guide 4 in FIG. 1, detects when the cop 2 mounted on the peg 3 is exhausted. The detector sends out a signal to actuate the solenoid 112 so as to turn the above-mentioned one-revolution clutch mechanism. Consequently, the group of cams 98 are rotated once according to the single rotation capability of the gears 100 and 99. According to the single turn of the group of cams 98, the lever 114 connected to the rod 78 is pulled upward by the clockwise turning motion of the lever 101, so that the bottom end of the rod 78 is engaged with the recess 80 of the plate 76 and the plate 76 is turned in the clockwise direction in FIG. 3. According to the above-mentioned turning motion of the plate 76, the peg 3 is also turned clockwise and peg 3 releases its hold on the bobbin of the exhausted cop. Next, the lever 104 is turned counterclockwise so that the rod 90 is pulled upward and the bobbin discharging plate 87 is turned in the clockwise direction in FIG. 7 so that the bobbin is taken off from the peg 3 and discharged outside the winding unit. In the above-mentioned discharging motion of the bobbin, the bobbin is capable of passing through a space between the opened doors 42 of the chute 9. Then the rod 78 is lowered and next the lever 102 is turned in the clockwise direction in FIG. 3 so that the lever 118 is turned in the counterclockwise direction. Consequently, the rod 39 is pushed toward the right-hand side in FIG. 3. When the rod 39 is so pushed, the detecting lever 38 is turned counterclockwise as shown in FIG. 5, and if the compartment 15 of the magazine 8 is empty, the detecting lever 38 is turned to its terminal position so that the L shaped lever 120 is fully turned in the clockwise direction in FIG. 3 by way of the lever 118 and the connecting rod 119.

According to the above-mentioned turning motion of the L shaped lever 120, the pin 121 pushes the rod 78 so that the rod 78 is pushed to the right hand side in FIG. 3 and the bottom end of the rod 78 is displaced from the recess 80 to the recess 79 of the plate 76 so as to turn the peg 3 toward the chute 11. If the compartment 15 of the magazine 8 is occupied with a fresh cop 2*a*, the free turning motion of the detecting lever 38 is stopped by the cop 2*a* and consequently, the pin 121 of the L shaped lever 120 does not contact the rod 78 and the engagement of the bottom end of the rod 78 with the recess 80 of the plate 76 is maintained. When the peg 3 is turned toward the chute 11, the V shaped arm 67 of the actuation member 66 pushes the lever 58 as shown in FIG. 8, the hook member 57 is disengaged from the doors 55 so that the doors 55 are opened and a cop 2*b* previously reserved in chute 11, drops onto the peg 3 so that a fresh cop 2*b* is held by the peg 3. As already illustrated in the explanation relating to chute 11, the rod 60 pulls the lever 61 so as to displace the rod 65 downward during the above-mentioned cop supply operation and consequently, any possibility of the supply of a fresh cop from the bucket conveyer 10 to the chute 11 is prevented.

When the rod 35 is pulled to the left hand side by way of the lever 123, the magazine 8 is turned one pitch.

After the one pitch turning motion of the magazine 8 which displaces one compartment 15 thereof from an upstream adjacent position to the position right above the cut-out portion 23 of the disc 22, the peg 3 is turned to its normal winding position, and the V shaped arm 67 of the actuation member 66 closes the doors 55 by direct contact action. When the arm 67 is removed from contact with the lever 58, the hook member 57 is engaged with the doors 55 in the closed condition, and simultaneously, the rod 60 is displaced upward. This results in the rod 65 also being displaced upward, as shown by a dotted line in FIG. 10, so as to await contact with a hook member 93 of a bucket 91 of the bucket conveyer 10.

According to the turning motion of the shaft 32, the lever 52 is turned against the spring 53 so that the lever 45 is turned as shown in FIG. 6, and consequently, the doors 42 are closed. Next, the lever 49 comes into contact with the doors 50 so as to close them. Therefore, a fresh cop 2*a* discharged from the compartment 15 of the magazine 8 is reserved temporarily in the chute 9. In the case where the fresh cap 2*a* rests on the detecting lever 38 of chute 9 the peg 3 is directed to the chute 9 and, therefore, according to the return motion of the rod 35, the doors 50 are opened and the fresh cop 2*a* drops onto the peg 3. Next the doors 42 are opened so as to await the discharging of a bobbin from the peg 3. After that, when the lever 101 is returned to its waiting position and the rod 78 is displaced downward, the peg 3 is turned to its winding position by the action of the spring 84 (FIG. 9). According to the above-mentioned turning motion of the peg 3, a bottom end of the sliding shaft 95 drops into a recess (not shown) formed in the hollow tube 72 so that the lever 96 is pushed outward. Therefore, the fresh cop 2*a* mounted on the peg 3 is held in a stable condition by the peg 3.

What is claimed is:

1. In an automatic winder provided with a plurality of stationary winding units installed in a row along a lengthwise direction of said winder, each winding unit being provided with a cop supply magazine having a plurality of cop reserve compartments, a method for supplying fresh cops to each winding unit comprising the steps of reserving a plurality of fresh cops in said cop reserve compartments respectively, carrying a plurality of fresh cops by an endless conveyer having a carrying passage formed parallel to a lengthwise direction of said winding machine at a position adjacent to a row of said winding units, and selectively supplying cops from either one of said magazine and endless conveyer to a cop holding device of each of said winding units when it is required to supply a cop.

2. A method for supplying fresh cops to each winding unit according to claim 1, wherein said step of selectively supplying cops comprises supplying cops from said magazine in preference to supplying cops from said endless conveyer.

3. A method for supplying fresh cops to each winding unit according to claim 2, further comprising detecting the existence of a cop in a compartment of said magazine in each winding unit prior to removing a cop from said magazine, and supplying a cop from said endless conveyer to a cop holding device on said winding unit upon detecting absence of a cop in said compartment of magazine.

4. In a stationary winding unit including a cop supply magazine having a plurality of cop reserve compartments and being movable to selectively discharge cops stored therein, an apparatus for supplying fresh cops to said winding unit comprising, in combination; an endless conveyer for carrying a plurality of fresh cops disposed at a position adjacent to said winding unit, a first cop feed chute disposed below and adjacent to said magazine of said winding unit for receiving cops discharged by said magazine, a second cop feed chute disposed at a position below and adjacent to said endless conveyer in said winding unit, a turnable cop receiving device disposed below said winding unit, means for selectively turning said cop receiving device between a first position in which a cop is received from said cop feed chute and a second position in which a cop is received from said second cop feed chute, means for selecting one of said magazine and conveyer as a cop supply device, and control means for controlling said movement of said magazine, said means for turning said cop receiving device and said selection means respectively.

5. An apparatus for supplying fresh cops to each winding unit according to claim 4, further comprising means for actuating said control means.

6. An apparatus for supplying fresh cops to said winding unit according to claim 5, wherein said magazine comprises a fixedly mounted bracket, a shaft rigidly supported by said bracket, a hollow shaft rotatably mounted on said first mentioned shaft, a plurality of upright cylindrical compartments having bottom apertures and secured at radial positions to said hollow shaft, a stationary disc held by said bracket at a position adjacent and below said compartments so as to close said bottom apertures of said compartments, said stationary disc having a cut-out portion formed therein, said cut-out portion forming a discharge aperture for supplying a cop from said magazine to said first cop feed chute.

7. An apparatus for supplying fresh cops to said winding unit according to claim 6, wherein said selecting means comprises a detecting device disposed in said magazine for detecting an existence of a cop in a compartment of said magazine at a position adjacent to said discharge aperture, said control means comprising means coupled to said detecting means for controlling said means for turning said cop receiving device.

8. An apparatus for supplying fresh cops to said winding unit according to claim 7, wherein said endless conveyer comprises an endless bucket conveyer having a plurality of buckets for holding separate fresh cops, each said bucket comprising door means for retaining a fresh cop in the respective bucket and being capable of being opened for discharging a fresh cop held in the respective bucket toward said second feed chute, an actuation rod rotatably mounted on each bucket and connected to control reopening and closing of the respective said door means, a movable rod on said second chute, means for projecting said movable rod into engagement with said actuation rod mounted on each bucket, said means for turning said cop receiving device comprising means for actuating said means for projecting said movable rod engage said actuation rod for opening the respective door means when said detecting device detects an absence of a cop in said compartment of magazine.

9. An apparatus for supplying fresh cops to said winding unit according to claim 5, wherein said first and second cop feed chutes each have a bottom aperture and door means for closing the respective bottom apertures thereof, said control means comprising means for opening said door means of said first cop feed chute for releasing a cop therefrom, said apparatus further comprising means responsive to turning of said cop receiving device for opening said door means of said second cop feed chute for releasing a cop therefrom.

* * * * *